US010121347B1

(12) United States Patent
Jones

(10) Patent No.: US 10,121,347 B1
(45) Date of Patent: Nov. 6, 2018

(54) BODILY TRACKING ASSEMBLY

(71) Applicant: Patricia Jones, Powder Springs, GA (US)

(72) Inventor: Patricia Jones, Powder Springs, GA (US)

( * ) Notice: Subject to any disclaimer, the term of this patent is extended or adjusted under 35 U.S.C. 154(b) by 0 days.

(21) Appl. No.: 15/855,481

(22) Filed: Dec. 27, 2017

(51) Int. Cl.
*G08B 21/02* (2006.01)

(52) U.S. Cl.
CPC ..... *G08B 21/0205* (2013.01); *G08B 21/0269* (2013.01); *G08B 21/0283* (2013.01); *G08B 21/0288* (2013.01)

(58) Field of Classification Search
CPC ..... G08B 21/0205; G08B 21/0269; G08B 21/0283; G08B 21/0288; G08B 21/0266; A61B 5/0022; A61B 5/0002; A61B 5/0031; A61B 5/02438; G04B 47/06; G04B 37/1486; A44C 5/20; A44C 5/2057
See application file for complete search history.

(56) References Cited

U.S. PATENT DOCUMENTS

D283,922 S 5/1986 Petersen
7,498,937 B2 3/2009 Martin et al.
9,002,372 B2 4/2015 Shakespeare
9,609,921 B1 * 4/2017 Feinstein ..... A44C 5/2071
9,668,551 B2 * 6/2017 Sanchez-Valenzuela ..... A44C 5/2076
2004/0183674 A1 * 9/2004 Ruvarac ..... G08B 21/0266 340/539.13
2008/0060172 A1 * 3/2008 Moss ..... A44C 5/20 24/373
2008/0066267 A1 * 3/2008 Azar ..... A44C 5/2071 24/303
2009/0231960 A1 9/2009 Hutchinson
2009/0280861 A1 11/2009 Khan
2010/0267361 A1 * 10/2010 Sullivan ..... G01S 19/17 455/404.2
2013/0278414 A1 * 10/2013 Sprigg ..... G08B 21/0453 340/539.12
2014/0028456 A1 * 1/2014 Sadhu ..... G08B 21/18 340/539.13
2014/0118149 A1 * 5/2014 Elias ..... G08B 21/0252 340/573.4
2014/0130544 A1 * 5/2014 Sanchez-Valenzuela ..... A44C 5/2076 63/1.13
2014/0323079 A1 * 10/2014 Paolini ..... G08B 25/016 455/404.2
2015/0085623 A1 * 3/2015 Modaragamage ..... A44C 5/24 368/10
2015/0216269 A1 * 8/2015 Fuhrman ..... A44C 5/2071 24/303
2015/0223705 A1 * 8/2015 Sadhu ..... G01S 19/17 600/301
2015/0247913 A1 * 9/2015 Messier ..... G01S 5/0027 340/539.13

(Continued)

*Primary Examiner* — An T Nguyen

(57) ABSTRACT

A bodily tracking assembly for allowing a caregiver to track and individual includes a bracelet that is worn. A tracking unit is coupled to the bracelet and the tracking unit is in electrical communication with a global positioning system thereby facilitating the tracking unit to establish a physical location of the bracelet. The tracking unit is in electrical communication with an electronic device thereby facilitating a caregiver to track a location of the bracelet.

12 Claims, 3 Drawing Sheets

(56) References Cited

U.S. PATENT DOCUMENTS

| | | | | |
|---|---|---|---|---|
| 2015/0378391 | A1* | 12/2015 | Huitema | G06F 1/163 361/679.03 |
| 2016/0066135 | A1* | 3/2016 | Zhang | H04W 4/02 455/456.3 |
| 2016/0150362 | A1* | 5/2016 | Shaprio | H04W 4/02 340/539.13 |
| 2016/0165853 | A1* | 6/2016 | Goldfain | A01K 29/005 340/573.3 |
| 2016/0174857 | A1* | 6/2016 | Eggers | G06F 19/3418 600/301 |
| 2016/0178392 | A1* | 6/2016 | Goldfain | G16H 40/63 702/104 |
| 2016/0203701 | A1* | 7/2016 | Woodard | G08B 25/016 340/573.1 |
| 2016/0283086 | A1* | 9/2016 | Inagaki | G06F 1/1626 |
| 2016/0306393 | A1* | 10/2016 | Huitema | G06F 3/0346 |
| 2016/0321901 | A1* | 11/2016 | Desoyza | A61B 5/747 |
| 2017/0064502 | A1* | 3/2017 | Stone | H04W 4/021 |
| 2017/0075308 | A1* | 3/2017 | Ivesha | G04G 17/04 |
| 2017/0103297 | A1 | 4/2017 | Daoura | |
| 2017/0178483 | A1* | 6/2017 | Shapiro | H04W 4/02 |
| 2017/0235341 | A1* | 8/2017 | Huitema | G06F 1/163 361/679.03 |
| 2017/0243385 | A1* | 8/2017 | Mitsugi | A44C 5/00 |
| 2017/0289754 | A1* | 10/2017 | Anderson | H04W 4/04 |
| 2017/0296058 | A1* | 10/2017 | Dunlavey | G06F 19/00 |
| 2018/0046214 | A1* | 2/2018 | Inagaki | H01L 51/0097 |
| 2018/0061203 | A1* | 3/2018 | Shapiro | H04W 4/02 |
| 2018/0139573 | A1* | 5/2018 | Anderson | H04W 4/025 |

* cited by examiner

BODILY TRACKING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tracking devices and more particularly pertains to a new tracking device for PURPOSE.

BRIEF SUMMARY OF THE INVENTION

An embodiment of the disclosure meets the needs presented above by generally comprising a bracelet that is worn. A tracking unit is coupled to the bracelet and the tracking unit is in electrical communication with a global positioning system thereby facilitating the tracking unit to establish a physical location of the bracelet. The tracking unit is in electrical communication with an electronic device thereby facilitating a caregiver to track a location of the bracelet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
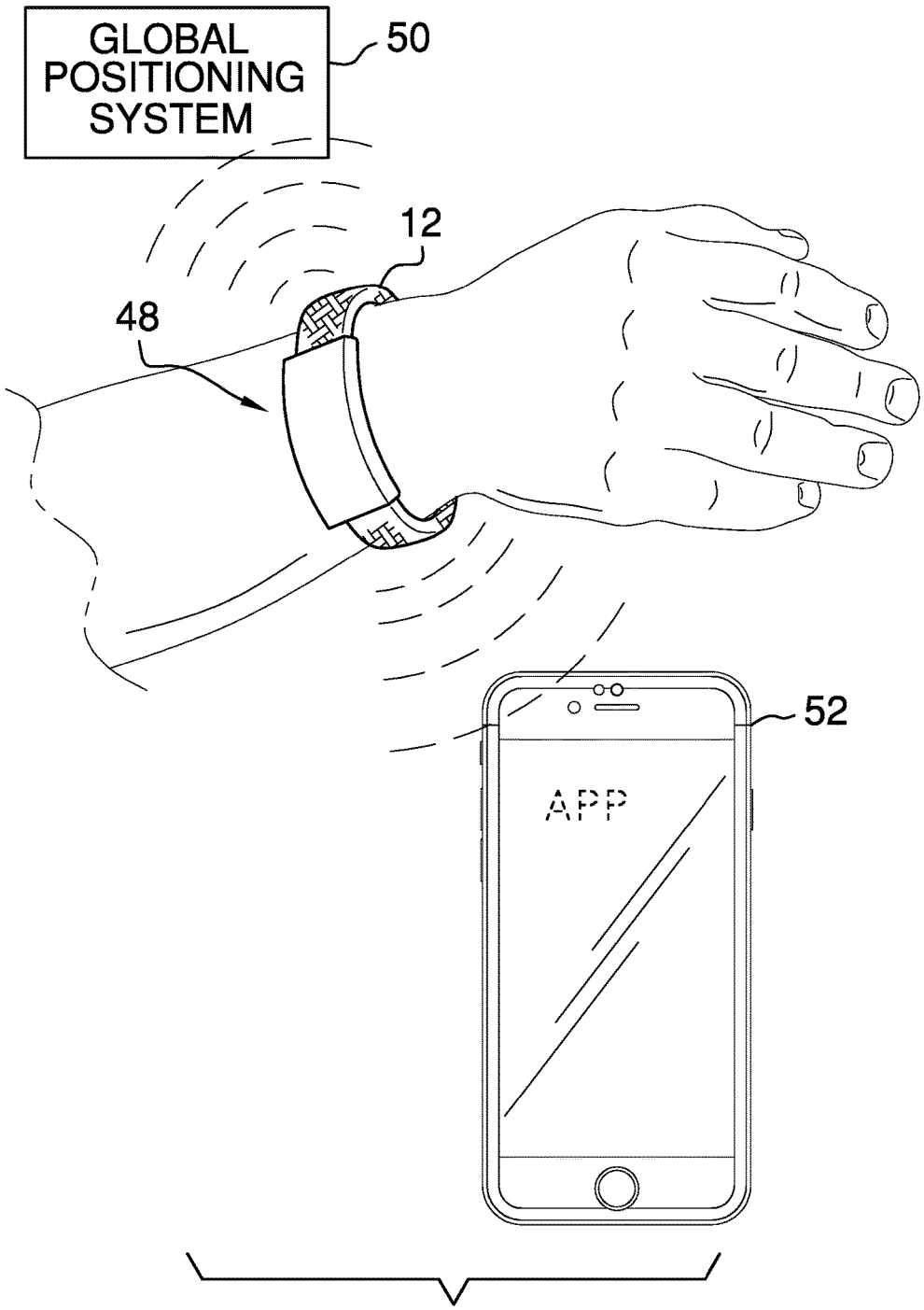
FIG. 1 is a perspective view of a bodily tracking assembly according to an embodiment of the disclosure.
Figure 2:
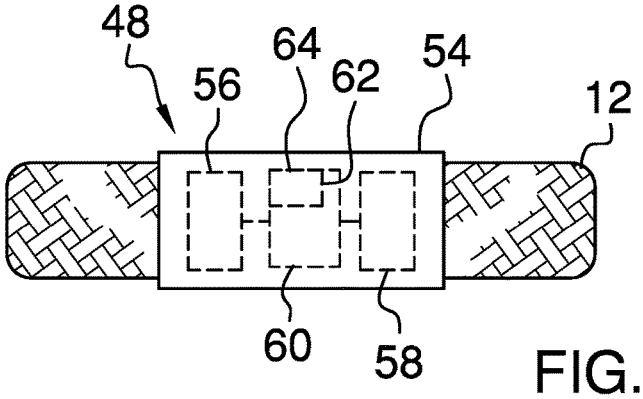
FIG. 2 is a top phantom view of an embodiment of the disclosure.
Figure 3:
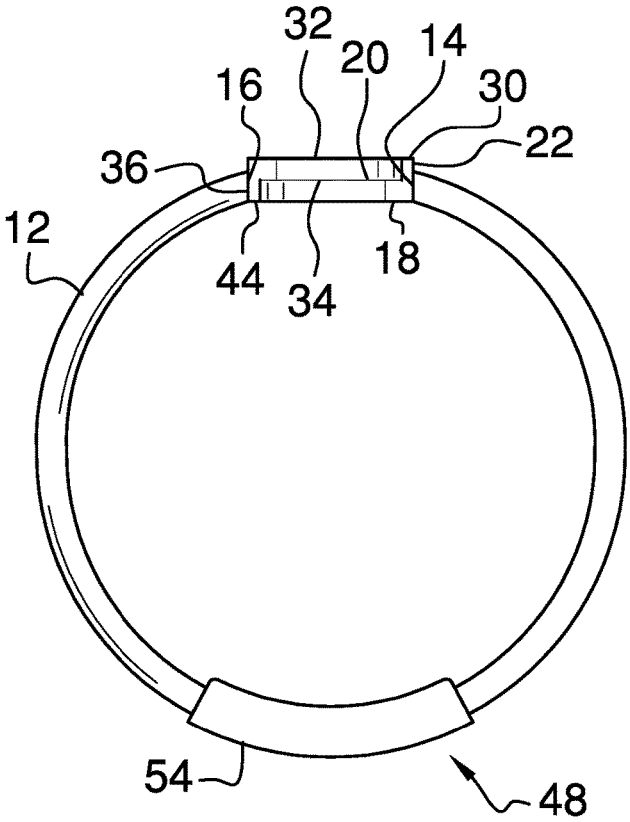
FIG. 3 is a front view of an embodiment of the disclosure.
Figure 4:
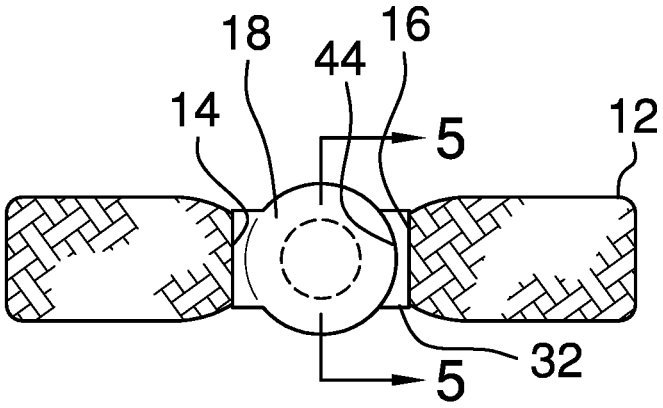
FIG. 4 is a bottom view of an embodiment of the disclosure.
Figure 5:
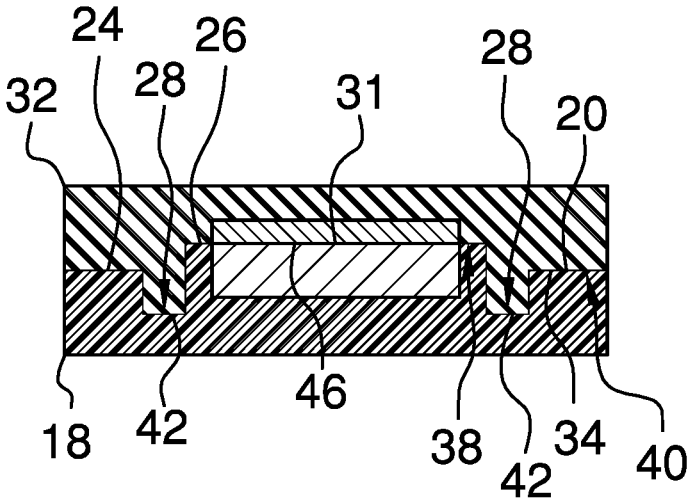
FIG. 5 is a cross sectional view taken along line 5-5 of FIG. 4 of an embodiment of the disclosure.

With reference now to the drawings, and in particular to FIGS. 1 through 5 thereof, a new tracking device embodying the principles and concepts of an embodiment of the disclosure and generally designated by the reference numeral 10 will be described.

As best illustrated in FIGS. 1 through 5, the bodily tracking assembly 10 generally comprises a bracelet 12 that has a first end 14 and a second end 16. A first mating member 18 is coupled to the first end 14 of the bracelet 12 and the first mating member 18 has a top surface 20 and a first lateral surface 22. The first lateral surface 22 is coupled to the first end 14 of the bracelet 12 and the top surface 20 has a first portion 24 that is recessed with respect to a second portion 26. The second portion 26 is centrally positioned on the top surface 20 and the first portion 24 has a slot 28 extending downwardly therein. The slot 28 is continuous such that the slot 28 forms a closed loop surrounding the second portion 26. Additionally, the first lateral surface 22 extends upwardly beyond the top surface 20 to define a first ledge 30. A first magnet 31 is coupled to the first mating member 18 and the first magnet 31 is positioned on the second portion 26 of the top surface 20.

A second mating member 32 is coupled to the second end 16 of the bracelet 12 and the second mating member 32 has a bottom surface 34 and a first lateral surface 36. The first lateral surface 36 of the second mating member 32 is coupled to the second end 16 of the bracelet 12. The bottom surface 34 has a primary portion 38 that is recessed with respect to a secondary portion 40. The primary portion 38 is centrally positioned on the bottom surface 34 and the secondary portion 40 has a tab 42 extending downwardly therefrom. The tab 42 is continuous such that the tab 42 forms a closed loop surrounding the primary portion 38.

The first lateral surface 36 of the second mating member 32 extends downwardly beyond the bottom surface 34 to define a second ledge 44. The second mating member 32 engages the first mating member 18 such that the tab 42 is positioned in the slot 28. In this way the second mating member 32 is inhibited from sliding on the first mating member 18. Additionally, the second mating member 32 abuts the first ledge 30 and the first mating member 18 abutting the second ledge 44. A second magnet 46 is coupled to the second mating member 32 and the second magnet 46 is positioned on the primary portion 38 of the bottom surface 34. The second magnet 46 magnetically engages the first magnet 31 when the first mating member 18 engages the second mating member 32.

A tracking unit 48 is provided and the tracking unit 48 is coupled to the bracelet 12. The tracking unit 48 is in electrical communication with a global positioning system 50 (GPS 50) thereby facilitating the tracking unit 48 to establish a physical location of the bracelet 12. Additionally, the tracking unit 48 is in electrical communication with an electronic device 52 thereby facilitating a caregiver to track a location of the bracelet 12. The electronic device 52 may be a smart phone or the like. The caregiver may be a parent, a medical professional and any other individual who is in charge of the person wearing the bracelet 12. The person wearing the bracelet 12 may be a child, a person with dementia and any other individual that needs to be supervised.

The tracking unit 48 comprises a housing 54 that is coupled to the bracelet 12. A processor 56 is positioned within the housing 54 and the processor 56 selectively sends an alert signal. An electronic memory 58 is positioned within the housing 54 and the electronic memory 58 stores a database pertaining to a predetermined schedule for the user of the bracelet 12 and permissible locations for the user of the bracelet 12. The permissible locations may be a selected radius from the electronic device, selected buildings and any other location determined by the caregiver. The electronic memory 58 is electrically coupled to the processor 56 and the electronic memory 58 may comprise a flash memory card or the like.

A transceiver 60 is positioned within the housing 54 and the transceiver 60 is electrically coupled to the processor 56. The transceiver 60 is in wireless electrical communication with the GPS 50 such that the transceiver 60 communicates the physical location of the bracelet 12 to the processor 56. Additionally, the transceiver 60 is in wireless electrical communication with the electronic device 52. Thus, the transceiver 60 receives the predetermined schedule and permissible locations from the electronic device 52.

The processor 56 sends the alert signal when the physical location of the bracelet 12 does not correspond to the permissible locations. Thus, the transceiver 60 communicates the alert signal to the electronic device 52 for notifying the caregiver that the user of the bracelet 12 has left the permissible location. The transceiver 60 may be a radio frequency transceiver 60 or the like and the transceiver 60 may be able to communicate via cellular phone networks, wireless internet access and other means of wireless, electronic communication. A power supply 62 is removably positioned within the housing 54. The power supply 62 is electrically coupled to the processor 56 and the power supply 62 comprises at least one battery 64.

In use, the bracelet 12 is worn on the wrist of the user and the caregiver programs the permissible locations and the schedule into the electronic device 52. The transceiver 60 is in constant communication with the GPS 50 and the electronic device 52. In this way the electronic device 52 immediately notifies the caregiver when the user of the bracelet 12 leaves the permissible locations. Additionally, the caregiver is able to verify that the user of the bracelet is at a selected location at a time that corresponds to the schedule. In this way the tracking unit 48 facilitates the caregiver to monitor all aspects of the user's daily routine. The transceiver 60 facilitates the bracelet 12 to be tracked on the electronic device 52 via the GPS 50 thereby facilitating the caregiver to locate the user of the bracelet 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bodily tracking assembly being configured to be worn by an individual for tracking the individual's location, said assembly comprising:

a bracelet being configured to be worn;

a first mating member being coupled to a first end of said bracelet, said first mating member having a top surface and a first lateral surface, said first lateral surface being coupled to said first end of said bracelet, said top surface having a first portion being recessed with respect to a second portion, said second portion being centrally positioned on said top surface, said first portion having a slot extending downwardly therein, said slot being continuous such that said slot forms a closed loop surrounding said second portion, said first lateral surface extending upwardly beyond said top surface to define a first ledge;

a first magnet being coupled to said first mating member, said first magnet being positioned on said second portion of said top surface, said first magnet being inset into said top surface such that an upper surface of said first magnet is coplanar with an upper face of said second portion, said slot being laterally spaced outwardly from said first magnet; and a tracking unit being coupled to said bracelet, said tracking unit being configured to be in electrical communication with a global positioning system thereby facilitating said tracking unit to establish a physical location of said bracelet, said tracking unit being configured to be in electrical communication with an electronic device thereby facilitating a caregiver to track a location of said bracelet.

2. The assembly according to claim 1, further comprising a second mating member being coupled to a second end of said bracelet, said second mating member having a bottom surface, and a first lateral surface, said first lateral surface of said second mating member being coupled to said second end of said bracelet.

3. The assembly according to claim 2, wherein said bottom surface has a primary portion being recessed with respect to a secondary portion, said primary portion being centrally positioned on said bottom surface.

4. The assembly according to claim 3, wherein said secondary portion has a tab extending downwardly therefrom, said tab being continuous such that said tab forms a closed loop surrounding said primary portion.

5. The assembly according to claim 4, wherein said first lateral surface of said second mating member extends downwardly beyond said bottom surface to define a second ledge, said second mating member engaging said first mating member having said tab being positioned in said slot, said second mating member abutting said first ledge, said first mating member abutting said second ledge.

6. The assembly according to claim 5, further comprising:

a first magnet being coupled to said first mating member; and a second magnet being coupled to said second mating member, said second magnet being positioned on said primary portion of said bottom surface, said second magnet magnetically engaging said first magnet when said first mating member engages said second mating member.

7. The assembly according to claim 1, wherein said tracking unit comprises:

a housing being coupled to said bracelet; and a processor being positioned within said housing, said processor selectively sending an alert signal.

8. The assembly according to claim 7, further comprising an electronic memory being positioned within said housing, said electronic memory storing a database pertaining to a predetermined schedule for a user of said bracelet and permissible locations for the user of said bracelet, said electronic memory being electrically coupled to said processor.

9. The assembly according to claim 8, further comprising a transceiver being positioned within said housing, said transceiver being electrically coupled to said processor, said transceiver being configured to be in wireless electrical communication with the gps such that said transceiver communicates the physical location of said bracelet to said processor, said transceiver being configured to be in wireless electrical communication with the electronic device thereby facilitating said transceiver to receive the predetermined schedule and permissible locations from the electronic device.

10. The assembly according to claim 9, wherein said processor sends the alert signal when the physical location of said bracelet does not correspond to the permissible locations wherein said transceiver is configured to communicate the alert signal to the electronic device for notifying the caregiver that the user of said bracelet has left the permissible locations.

11. The assembly according to claim 10, further comprising a power supply being removably positioned within said housing, said power supply being electrically coupled to said processor, said power supply comprising at least one battery.

12. A bodily tracking assembly being configured to be worn by an individual for tracking the individual's location, said assembly comprising:

a bracelet being configured to be worn, said bracelet having a first end and a second end;

a first mating member being coupled to said first end of said bracelet, said first mating member having a top surface and a first lateral surface, said first lateral surface being coupled to said first end of said bracelet, said top surface having a first portion being recessed with respect to a second portion, said second portion being centrally positioned on said top surface, said first portion having a slot extending downwardly therein, said slot being continuous such that said slot forms a closed loop surrounding said second portion, said first lateral surface extending upwardly beyond said top surface to define a first ledge;

a first magnet being coupled to said first mating member, said first magnet being positioned on said second portion of said top surface, said first magnet being inset into said top surface such that an upper surface of said first magnet is coplanar with an upper face of said second portion, said slot being laterally spaced outwardly from said first magnet;

a second mating member being coupled to said second end of said bracelet, said second mating member having a bottom surface, and a first lateral surface, said first lateral surface of said second mating member being coupled to said second end of said bracelet, said bottom surface having a primary portion being recessed with respect to a secondary portion, said primary portion being centrally positioned on said bottom surface, said secondary portion having a tab extending downwardly therefrom, said tab being continuous such that said tab forms a closed loop surrounding said primary portion, said first lateral surface of said second mating member extending downwardly beyond said bottom surface to define a second ledge, said second mating member engaging said first mating member having said tab being positioned in said slot, said second mating member abutting said first ledge, said first mating member abutting said second ledge;

a second magnet being coupled to said second mating member, said second magnet being positioned on said primary portion of said bottom surface, said second magnet magnetically engaging said first magnet when said first mating member engages said second mating member; and a tracking unit being coupled to said bracelet, said tracking unit being configured to be in electrical communication with a global positioning system thereby facilitating said tracking unit to establish a physical location of said bracelet, said tracking unit being configured to be in electrical communication with an electronic device thereby facilitating a caregiver to track a location of said bracelet, said tracking unit comprising:

a housing being coupled to said bracelet;

a processor being positioned within said housing, said processor selectively sending an alert signal;

an electronic memory being positioned within said housing, said electronic memory storing a database pertaining to a predetermined schedule for a user of said bracelet and permissible locations for the user of said bracelet, said electronic memory being electrically coupled to said processor;

a transceiver being positioned within said housing, said transceiver being electrically coupled to said processor, said transceiver being configured to be in wireless electrical communication with the gps such that said transceiver communicates the physical location of said bracelet to said processor, said transceiver being configured to be in wireless electrical communication with the electronic device thereby facilitating said transceiver to receive the predetermined schedule and permissible locations from the electronic device, said processor sending the alert signal when the physical location of said bracelet does not correspond to the permissible locations wherein said transceiver is configured to communicate the alert signal to the electronic device for notifying the caregiver that the user of said bracelet has left the permissible locations; and a power supply being removably positioned within said housing, said power supply being electrically coupled to said processor, said power supply comprising at least one battery.

* * * * *